US005890638A

United States Patent [19]

Woloshen

[11] Patent Number: 5,890,638

[45] Date of Patent: Apr. 6, 1999

[54] BELT MOUNTED HAT CLIP

[76] Inventor: B. Jim Woloshen, 2 - 802 1st Street, Estevan, Sask, Canada, S4A 0G3

[21] Appl. No.: 963,635

[22] Filed: Nov. 6, 1997

[51] Int. Cl.[6] ..... A45F 5/00

[52] U.S. Cl. ..... 224/247; 224/269; 224/673; 224/191; 24/3.1; 24/3.11

[58] Field of Search ..... 224/191, 660, 224/665, 666, 668–673, 247, 248, 268, 269, 272; 24/3.1, 3.11, 3–12

[56] References Cited

U.S. PATENT DOCUMENTS

| | | | |
|---|---|---|---|
| 990,868 | 5/1911 | Hedgpeth | 24/3.12 |
| 1,396,499 | 11/1921 | Bell | 24/3.12 |
| 1,449,257 | 3/1923 | Banks | 224/247 |
| 4,277,863 | 7/1981 | Faneuf | 224/247 |
| 4,453,656 | 6/1984 | Gillum | 224/269 |
| 4,739,914 | 4/1988 | Pothetes | 224/673 |
| 5,388,741 | 2/1995 | Hillinger | 224/673 |

FOREIGN PATENT DOCUMENTS

| | | | |
|---|---|---|---|
| 92222 | 9/1968 | France | 224/247 |
| 13512 A | 8/1881 | Germany | 24/3.1 |
| 21857 | 10/1907 | United Kingdom | 24/3.1 |

*Primary Examiner*—Allan N. Shoap
*Assistant Examiner*—Gregory M. Vidovich

[57] ABSTRACT

A belt mounted hat clip is provided including a rear portion having belt coupling mechanism for being removably mounted to a belt. A front portion is included having a rest orientation for gripping a visor of a hat and a biased orientation for allowing the hat to be removed.

7 Claims, 2 Drawing Sheets

BELT MOUNTED HAT CLIP

BACKGROUND OF THE INVENTION

1. Field of the Invention

The present invention relates to belt clips and more particularly pertains to a new belt mounted hat clip for securing a hat to a belt of a user.

2. Description of the Prior Art

The use of belt clips is known in the prior art. More specifically, belt clips heretofore devised and utilized are known to consist basically of familiar, expected and obvious structural configurations, notwithstanding the myriad of designs encompassed by the crowded prior art which have been developed for the fulfillment of countless objectives and requirements.

Known prior art belt clips include U.S. Pat. No. 4,358,036; U.S. Pat. No. 4,991,236; U.S. Pat. Des. 251,345; U.S. Pat. No. 4,821,934; U.S. Pat. No. 5,241,728; and U.S. Pat. No. 3,950,829.

In these respects, the belt mounted hat clip according to the present invention substantially departs from the conventional concepts and designs of the prior art, and in so doing provides an apparatus primarily developed for the purpose of securing a hat to a belt of a user.

SUMMARY OF THE INVENTION

In view of the foregoing disadvantages inherent in the known types of belt clips now present in the prior art, the present invention provides a new belt mounted hat clip construction wherein the same can be utilized for securing a hat to a belt of a user.

The general purpose of the present invention, which will be described subsequently in greater detail, is to provide a new belt mounted hat clip apparatus and method which has many of the advantages of the belt clips mentioned heretofore and many novel features that result in a new belt mounted hat clip which is not anticipated, rendered obvious, suggested, or even implied by any of the prior art belt clips, either alone or in any combination thereof.

To attain this, the present invention generally comprises a vertically oriented rear portion having a rectangular configuration with a front face, a rear face and a periphery. The periphery is defined by a pair of long vertical side edges and a pair of short horizontal top and bottom edges. As shown in FIG. 2, the rear portion has a rectangular foam pad mounted on the front face along the bottom edge thereof. Various coupling mechanisms are included for being removably secured to a belt of the user. A slot is formed between the side edges adjacent to the top edge of the rear portion for allowing the belt to be passed therethrough. A rectangular tab is integrally coupled to the top edge of the rear portion and extending upwardly therefrom in coplanar relationship with the front face. Such tab has an aperture formed therein for allowing the rear portion to be hung on a post. A belt clip is provided including a horizontal portion integrally coupled to the rear face of the rear portion adjacent the top edge. Integrally coupled to the horizontal portion is a generally vertical portion which extends downwardly therefrom for being removably secured to the belt. Further provided is a front portion. A central extent of the front portion is pivotally coupled to a central extent of the side edges of the rear portion. The front portion includes an upper extent with a handle extending upwardly and outwardly from the side edges. A lower extent of the front portion has a generally U-shaped vertical cross-section taken along a plane perpendicular with the rear portion. A bottom end of the lower extent has a rectangular foam pad coupled thereto. The front portion has a rest orientation with the foam pads abutting each other for gripping a visor of a hat. The front portion further has a biased orientation upon the depression of the handle with the foam pads distanced from each other for allowing the hat to be removed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt mounted hat clip apparatus and method which has many of the advantages of the belt clips mentioned heretofore and many novel features that result in a new belt mounted hat clip which is not anticipated, rendered obvious, suggested, or even implied by any of the prior art belt clips, either alone or in any combination thereof.

It is another object of the present invention to provide a new belt mounted hat clip which may be easily and efficiently manufactured and marketed.

It is a further object of the present invention to provide a new belt mounted hat clip which is of a durable and reliable construction.

An even further object of the present invention is to provide a new belt mounted hat clip which is susceptible of a low cost of manufacture with regard to both materials and labor, and which accordingly is then susceptible of low prices of sale to the consuming public, thereby making such belt mounted hat clip economically available to the buying public.

Still yet another object of the present invention is to provide a new belt mounted hat clip which provides in the apparatuses and methods of the prior art some of the advantages thereof, while simultaneously overcoming some of the disadvantages normally associated therewith.

Still another object of the present invention is to provide a new belt mounted hat clip for securing a hat to a belt of a user.

Even still another object of the present invention is to provide a new belt mounted hat clip that includes a rear portion having belt coupling mechanism for being removably mounted to a belt. A front portion is included having a rest orientation for gripping a visor of a hat and a biased orientation for allowing the hat to be removed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
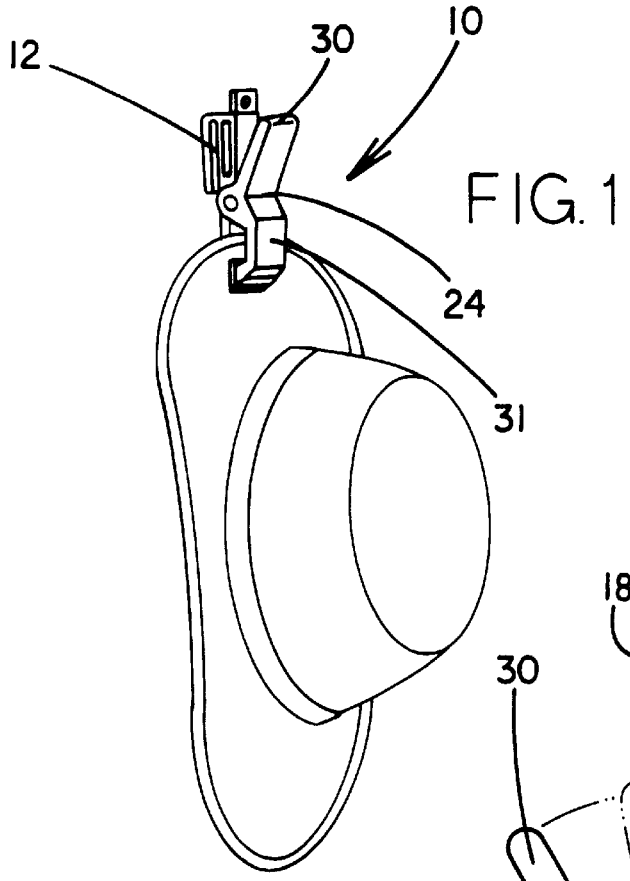
FIG. 1 is a perspective view of a new belt mounted hat clip according to the present invention.

With reference now to the drawings, and in particular to FIGS. 1 through 4 thereof, a new belt mounted hat clip embodying the principles and concepts of the present invention and generally designated by the reference numeral 10 will be described.

Figure 2:
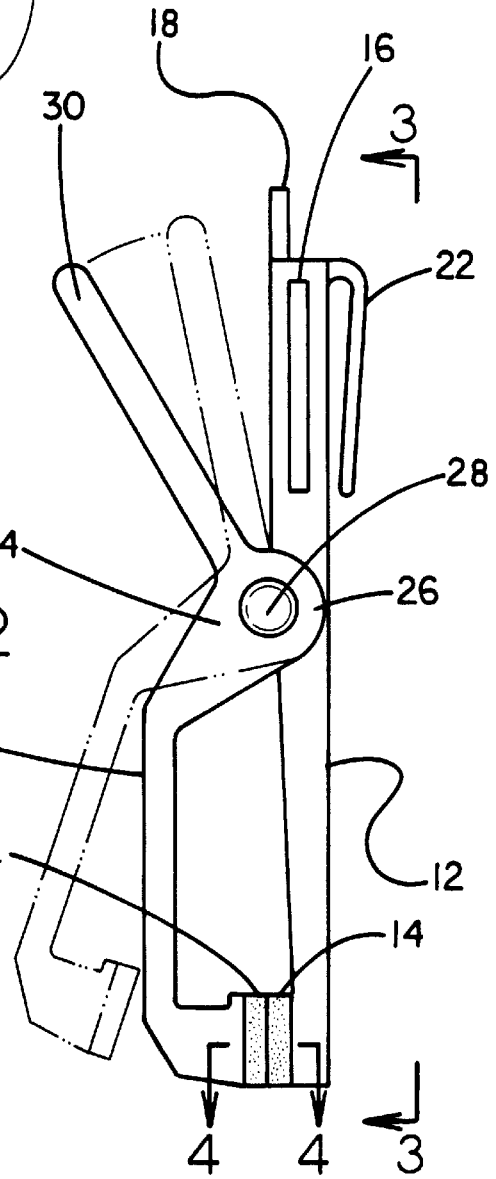
FIG. 2 is a side view of the present invention.
Figure 3:
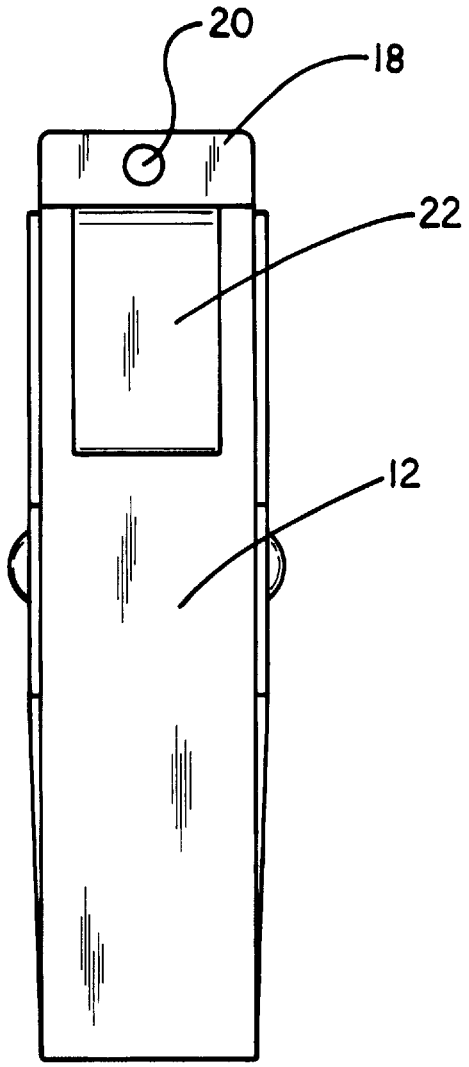
FIG. 3 is a rear view of the present invention.
Figure 4:
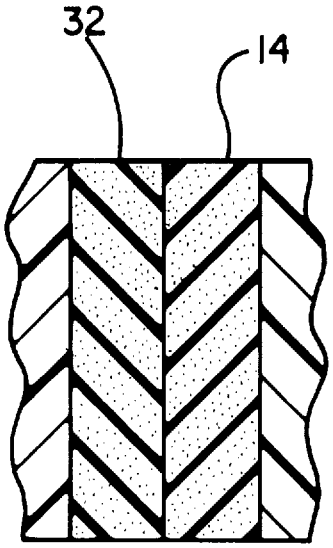
FIG. 4 is a close-up cross-sectional view of the foam pads of the present invention taken along line 4—4 shown in FIG. 2.

The present invention, as designated as numeral 10, includes a vertically oriented rear portion 12 having a rectangular configuration with a front face, a rear face and a periphery. The periphery is defined by a pair of long vertical side edges and a pair of short horizontal top and bottom edges. As shown in FIG. 2, the rear portion has a rectangular foam pad 14 mounted on the front face along the bottom edge thereof.

Various coupling mechanisms are included for being removably secured to a belt of the user. A slot 16 is formed between the side edges adjacent to the top edge of the rear portion for allowing the belt to be passed therethrough. A rectangular tab 18 is integrally coupled to the top edge of the rear portion and extending upwardly therefrom in coplanar relationship with the front face. Such tab has an aperture 20 formed therein for allowing the rear portion to be hung on a post. A belt clip 22 is provided including a horizontal portion integrally coupled to the rear face of the rear portion adjacent the top edge. Integrally coupled to the horizontal portion is a generally vertical portion which extends downwardly therefrom for being removably secured to the belt. Preferably, the vertical portion extends downwardly a distance of about ¼ the length of the rear portion.

Further provided is a front portion 24. A central extent of the front portion is pivotally coupled to a central extent of the side edges of the rear portion. Such pivotal coupling is accomplished by way of a fork 26 formed on the front portion, an unillustrated lateral bore formed in the rear portion and a pivot rod 28 rotatably coupled therebetween. The front portion includes an upper extent with a handle 30 extending upwardly and outwardly from the side edges. A lower extent 31 of the front portion has a generally U-shaped vertical cross-section taken along a plane perpendicular with the rear portion. A bottom end of the lower extent has a rectangular foam pad 32 coupled thereto. In the preferred embodiment, a free face of foam pad 14 has a convex surface and the same of foam pad 32 has a concave surface to conform to a visor of the hat, as will soon become apparent.

During use, the front portion has a rest orientation with the foam pads abutting each other for gripping a visor of a hat. In such orientation, the handle forms a 45 degree angle with the rear portion. Further, the U-shaped configuration of the lower extent of the front portion is critical for allowing a crest of the hat to pass therethrough unharmed. The front portion further has a biased orientation upon the depression of the handle with the foam pads distanced from each other for allowing the hat to be removed. The front portion is biased in the present orientation due to an unillustrated spring mounted between the rear and front portions. It should be noted that the front and rear portions may be constructed from any one of various colors.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A belt mountable hat clip comprising, in combination:

a vertically oriented rear portion having a rectangular configuration with a front face, a rear face and a periphery defined by a pair of long vertical side edges and a pair of short horizontal top and bottom edges, the rear portion having a rectangular foam pad mounted on the front face along the bottom edge thereof, a slot formed between the side edges adjacent to the top edge of the rear portion for allowing a belt to be passed therethrough, a rectangular tab integrally coupled to the top edge of the rear portion and extending upwardly therefrom in coplanar relationship with the front face wherein the tab has an aperture formed therein for allowing the rear portion to be hung on a post, and a belt clip including a horizontal portion integrally coupled to the rear face of the rear portion adjacent the top edge and a generally vertical portion integrally coupled to the horizontal portion and extending downwardly therefrom for being removably secured to a belt; and a front portion having a central extent pivotally coupled to a central extent of the side edges of the rear portion, the front portion including an upper extent with a handle extending upwardly and outwardly from the side edges and a lower extent having a generally U-shaped vertical cross-section taken along a vertical plane perpendicular with the front face of the rear portion, a bottom end of the lower extent having a rectangular foam pad coupled thereto, whereby the front portion has a rest orientation with the foam pads abutting each other for gripping a visor of a hat and a biased orientation upon the depression of the handle with the foam pads distanced from each other for allowing the hat to be removed.

2. A belt mountable hat clip comprising:

a rear portion having a couple for being removably mounted to a belt; and a front portion having a rest orientation for gripping a visor of a hat and a biased orientation for allowing the hat to be removed;

wherein the front portion includes an upper extent with a handle extending upwardly;

wherein the front portion has a central extent pivotally coupled to a central extent of the rear portion about an axis which resides in parallel with a plane in which a front face of the rear portion resides;

wherein a lower extent of the front portion has a generally U-shaped vertical cross-section defined by a base member and two arm members extending outwardly therefrom toward the rear portion, the base member of the lower extent having a face substantially parallel to an opposing front face of the rear portion when the front portion is in the rest orientation, the U-shaped lower extent having an opening directed toward the front face of the rear portion for accepting a thickened rim edge of a hat when the hat is positioned between the front and rear portions.

3. A belt mountable hat clip as set forth in claim 2 wherein the couple is a slot for a belt to pass therethrough.

4. A belt mountable hat clip as set forth in claim 2 further including an apertured tab for allowing the rear portion to be mounted away from a belt.

5. A belt mountable hat clip as set forth in claim 2 wherein the couple is a belt clip for removably securing to a belt.

6. A belt mounted hat clip as set forth in claim 2 wherein the front portion and rear portion each have a foam pad mounted thereon.

7. A belt mountable hat clip comprising:

a vertically oriented rear portion with a front face, a rear face and a periphery defined by a pair of long vertical side edges and a pair of short horizontal top and bottom edges, the rear portion having a slot formed between the side edges between the front face and the rear face and adjacent to the top edge of the rear portion for allowing a belt to be passed therethrough, a rectangular tab integrally coupled to the top edge of the rear portion and extending upwardly therefrom in coplanar relationship with the front face wherein the tab has an aperture formed therein for allowing the rear portion to be hung, and a belt clip including a horizontal portion integrally coupled to the rear face of the rear portion adjacent the top edge and a generally vertical portion integrally coupled to the horizontal portion and extending downwardly therefrom for being removably secured to a belt; and a front portion connected to the rear portion for securing a hat therebetween.

* * * * *